US008215517B2

(12) United States Patent
Chohfi et al.

(10) Patent No.: US 8,215,517 B2
(45) Date of Patent: Jul. 10, 2012

(54) COMPRESSED GAS CYLINDER HAVING CONDUCTIVE POLYMERIC FOOT RING

(75) Inventors: William Chohfi, Porto (PT); Carlos Aguiar, Burgo (PT)

(73) Assignee: AMTROL Licensing, Inc., West Warwick, RI (US)

( * ) Notice: Subject to any disclaimer, the term of this patent is extended or adjusted under 35 U.S.C. 154(b) by 809 days.

(21) Appl. No.: 12/316,818

(22) Filed: Dec. 17, 2008

(65) Prior Publication Data

US 2010/0147859 A1 Jun. 17, 2010

(51) Int. Cl.
*F17C 1/00* (2006.01)
*B65D 21/02* (2006.01)
*A47G 23/02* (2006.01)

(52) U.S. Cl. ..... 220/581; 220/23.91; 248/146

(58) Field of Classification Search ..... 220/581, 220/23.91, 632, 633, 634, 655, 657, 649, 220/630, 23.87, 560.04, 724, 592, 4.26, 4.31, 220/237, 254.7, 790; 206/521.2, 521.3, 521.6, 206/521.8, 587, 591, 592, 594, 149, 151, 206/154, 159, 160; 248/146
See application file for complete search history.

(56) References Cited

U.S. PATENT DOCUMENTS 3,349,940 A * 10/1967 Cornelius ..... 220/592.19
4,907,712 A * 3/1990 Stempin ..... 220/630
4,932,621 A * 6/1990 Kowk ..... 248/146
5,597,085 A * 1/1997 Rauworth et al. ..... 220/581
D460,519 S 7/2002 Chohfi et al.
D576,702 S 9/2008 Aguiar et al.
7,621,565 B2 * 11/2009 Ross et al. ..... 280/830
7,699,188 B2 * 4/2010 Oliveira et al. ..... 220/586

FOREIGN PATENT DOCUMENTS

JP 09-329299 A 12/1997
JP 10-274391 A 10/1998
JP 2000-234699 A 8/2000
KR 20-0263715 2/2002

OTHER PUBLICATIONS

International Search Report for PCT/US2009/068279, dated May 31, 2010.
Written Opinion of the International Search Report for PCT/US2009/068279, dated May 31, 2010.
International Preliminary Report on Patentability dated Jun. 30, 2011.

* cited by examiner

*Primary Examiner* — Bryon Gehman
*Assistant Examiner* — Shawn Braden
(74) *Attorney, Agent, or Firm* — Scott D. Wofsy; Edwards Wildman Palmer LLP

(57) ABSTRACT

A compressed gas cylinder assembly is disclosed which includes a metallic cylinder body having an upper end portion with handles and a flow control valve, and a lower end portion with a convex surface from which depends a lower support ring. A non-conductive annular collar surrounds the lower support ring of the cylinder body, and a conductive foot ring connects the annular collar to the lower support ring of the cylinder body, providing a conductive path to ground for the metallic cylinder body.

7 Claims, 7 Drawing Sheets

COMPRESSED GAS CYLINDER HAVING CONDUCTIVE POLYMERIC FOOT RING

BACKGROUND OF THE INVENTION

1. Field of the Invention

The subject invention is directed to compressed gas cylinders, and more particularly, to a high-strength, light-weight compressed gas cylinder having a metallic body and a foot ring formed from a conductive polymeric material, which provides a conductive pathway for permitting the discharge of static electricity from the metallic cylinder body.

2. Description of Related Art

Compressed gas cylinders are well known in the art and have been widely used in various applications, such as, for example, the storage of Liquefied Petroleum Gas (LPG) for cooking appliances such as stoves and grills. Typically, a compressed gas cylinder comprises a steel cylindrical body having a valve at the top for controlling the flow of gas from cylinder and a footing at the bottom to provide stability for the cylinder upon a supporting surface.

A drawback of traditional steel cylinders is that when they are taken indoors, for example, inside the kitchen or into other living areas of the home, the footing tends to leave rust stains on the flooring or carpeting of the home. One solution would be to attach a plastic foot ring to the bottom of the cylinder using an adhesive.

However, there are certain problems associated with using a plastic foot ring. In particular, when a gas cylinder enters a filling station it must not have a significant static charge anywhere in its body. Yet, a plastic foot ring, being non-conductive, does not permit the discharge of static electricity from the cylinder body to the grounded metallic filling platform or transport chains of the filling station. Consequently, the insulated cylinder can be a spark source which could lead to an explosion in a highly volatile environment.

It would be beneficial therefore to provide a compressed gas cylinder that overcomes the disadvantages of prior art metallic footings as well as those that would be associated with using a plastic foot ring which is unable to discharge static electricity from a metallic cylinder.

SUMMARY OF THE INVENTION

The subject invention is directed to a new and useful compressed gas cylinder assembly that includes, among other things, a cylinder body having an upper end portion and a lower end portion. The upper end portion has a flow control valve associated therewith for metering the flow of compressed gas from the cylinder and a pair of handles for carrying the cylinder assembly from one location to another. The lower end portion of the cylinder body has a convex surface area from which depends a lower support ring. An annular collar formed from a light-weight plastic material surrounds the lower support ring, and a foot ring connects the annular collar to the lower support ring.

The lower support ring is rigidly attached to the lower end portion of the cylinder body by welding or by similar mechanical joining techniques, and is defined by an annular wall having a radially outwardly projecting support flange. The cylinder body and the lower support ring are formed from a metallic material, such as, for example, steel. Preferably, the foot ring is formed from a conductive or semi-conductive polymeric material, such as for example, a semi-conductive compound based on polypropylene. As such, the conductive foot ring provides an electrical discharge path to ground for the cylinder body.

The annular collar has a plurality of circumferentially spaced apart radially inwardly facing engagement struts for engaging the support flange of the lower support ring about the periphery thereof. The foot ring defines an annular channel for accommodating the engagement struts of the annular collar and the lower support ring of the cylinder body. The annular channel of the foot ring includes a radially inner upstanding wall that is dimensioned and configured to intimately contact and surround an inner periphery of the annular wall of the lower support ring. The annular channel further includes a plurality of circumferentially spaced apart radially outer upstanding engagement tangs that are dimensioned and configured to engage the annular collar in interleaved relationship with the plurality of circumferentially spaced apart engagement struts.

The subject invention is also directed to a gas cylinder assembly that includes a cylinder body having an upper end portion with a flow control valve and carrying handles, and a lower end portion having a convex surface area with a depending lower support ring. The assembly further includes an annular collar connected to the lower support ring of the cylinder body and including a plurality of circumferentially spaced apart upstanding shock absorbing fins that are dimensioned and configured to interact with the convex surface area of the lower end portion of the cylinder body. A foot ring connects the annular collar to the lower support ring of the cylinder body.

These and other features of the compressed gas cylinder assembly of the subject invention, and the conductive polymeric foot ring associated therewith, will become more readily apparent to those having ordinary skill in the art from the following detailed description of the preferred embodiments in conjunction with the associated drawing figures.

BRIEF DESCRIPTION OF THE DRAWINGS

So that those skilled in the art to which the subject invention appertains will readily understand how to make and use the compressed gas cylinder assembly of the subject invention without undue experimentation, preferred embodiments thereof will be described in detail herein below with reference to certain figures, wherein.

DETAILED DESCRIPTION OF PREFERRED EMBODIMENTS

Figure 1:
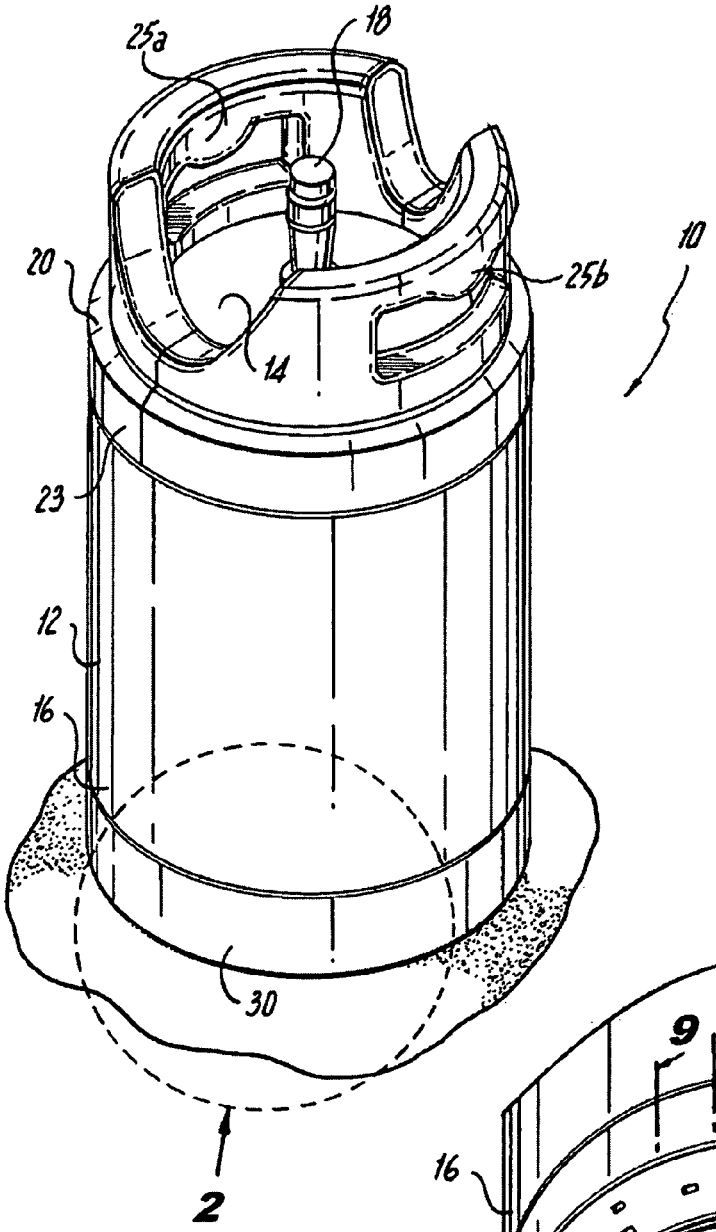
FIG. 1 is a perspective view of a compressed gas cylinder constructed in accordance with a preferred embodiment if the subject invention.

Referring now to the drawings, wherein like reference numerals identify or otherwise refer to similar structural features or elements of the various embodiments of the subject invention, there is illustrated in FIG. 1 a compressed gas cylinder assembly constructed in accordance with a preferred embodiment of the subject invention and designated generally by reference numeral 10. Compressed gas cylinder assembly 10 is used for storing gases such as Liquefied Petroleum Gas (also called LPG, GPL or LP Gas) which is a mixture of hydrocarbon gases typically used as a fuel in heating and cooking appliances. Varieties of LPG bought and sold include blends that are primarily propane, blends that are primarily butane, and blends that include both propane (60%) and butane (40%). Propylene and butylenes are usually also present in small concentration. An odorant is typically added so that leaks can be easily detected easily. Other gases may also be stored in gas cylinder assembly 10 such as, for example, refrigerants, helium or nitrogen or the like.

Compressed gas cylinder assembly 10 includes a cylinder body 12 having an upper end portion 14 and a lower end portion 16. Cylinder body 12 is preferably made from steel or a similar metallic material. A flow control valve 18 is operatively associated with the upper end portion 14 of cylindrical body 12 for metering the flow of compressed gas from the cylinder 10. It is envisioned that the flow control valve 18 may be a refillable valve or a non-refillable valve.

A handle assembly 20 having a cylindrical skirt 23 and a pair of ergonomically shaped handles 25*a* and 25*b* is also associated with the upper end portion 14 of cylinder body 12 for carrying the cylinder assembly 10 from one location to another. Handle assembly 20 is preferably formed from a light weight plastic material, such as, for example, polypropylene or high density polyethylene, and may be formed as a unitary structure or a two-part structure having interior mating features to securely engage the upper end portion 14 of the cylinder body 12 during assembly. Another example of ergonomically designed handles of this type are disclosed in commonly assigned U.S. Design Pat. No 460,519 to Chohfi et al.

Figure 3:
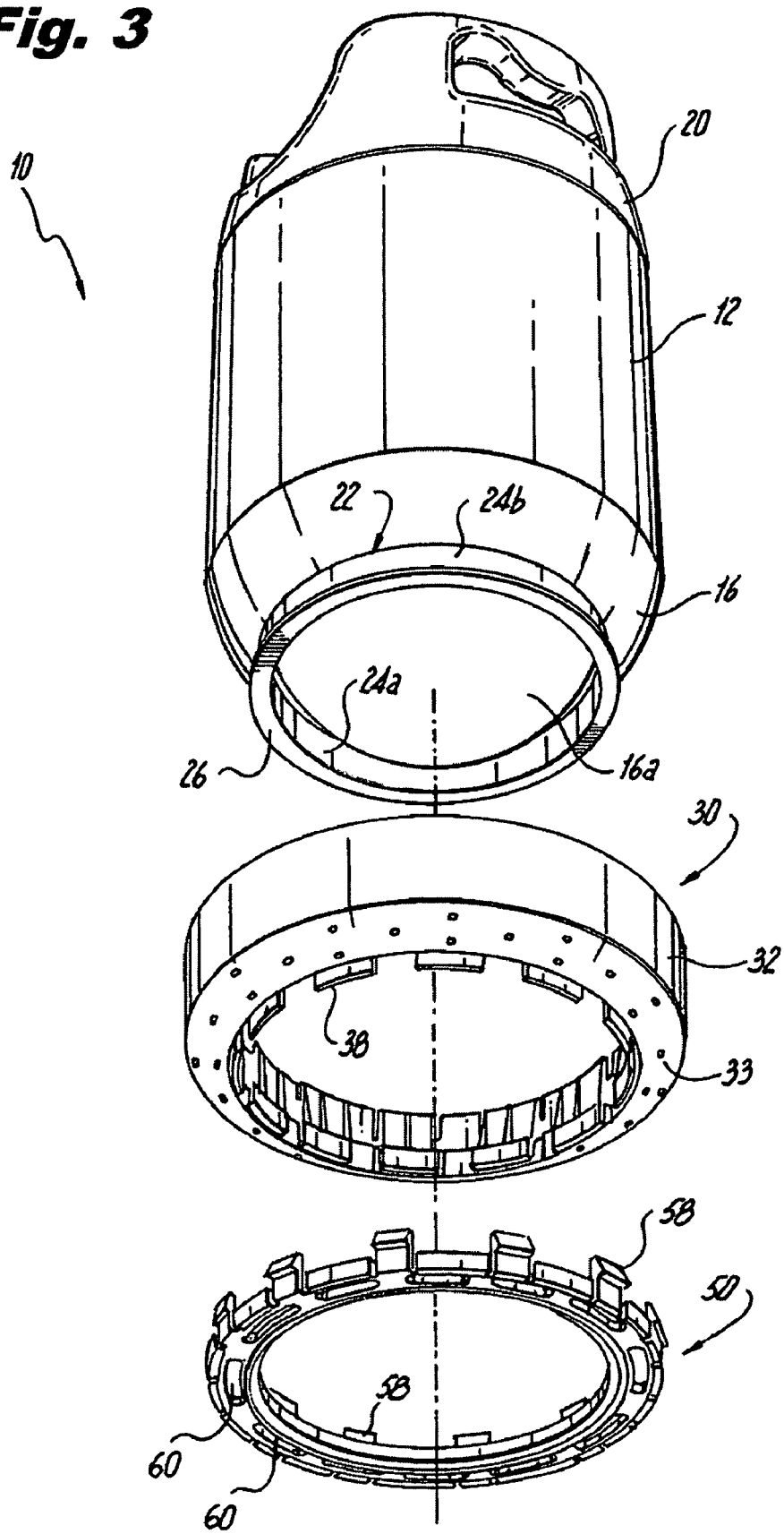
FIG. 3 is an exploded perspective view of the compressed gas cylinder of the subject invention, with parts separated for ease of illustration, including the cylinder body, the annular collar and the foot ring.

As best seen in FIG. 3, the lower end portion 16 of cylinder body 12 has a rounded, generally convex surface area 16*a*. A lower support ring 22 depends downwardly from the convex surface area 16*a* of the lower end portion 16 of the cylinder body 12 to form a stable platform for the cylinder body 10. Support ring 22 includes an inner peripheral surface 24*a*, an outer peripheral surface 24*b* and a radially outwardly projecting support flange 26. Preferably, the lower support ring 22 is welded to or otherwise joined with the lower end portion 16 of cylinder body 12 in a conventional manner.

Figure 2:
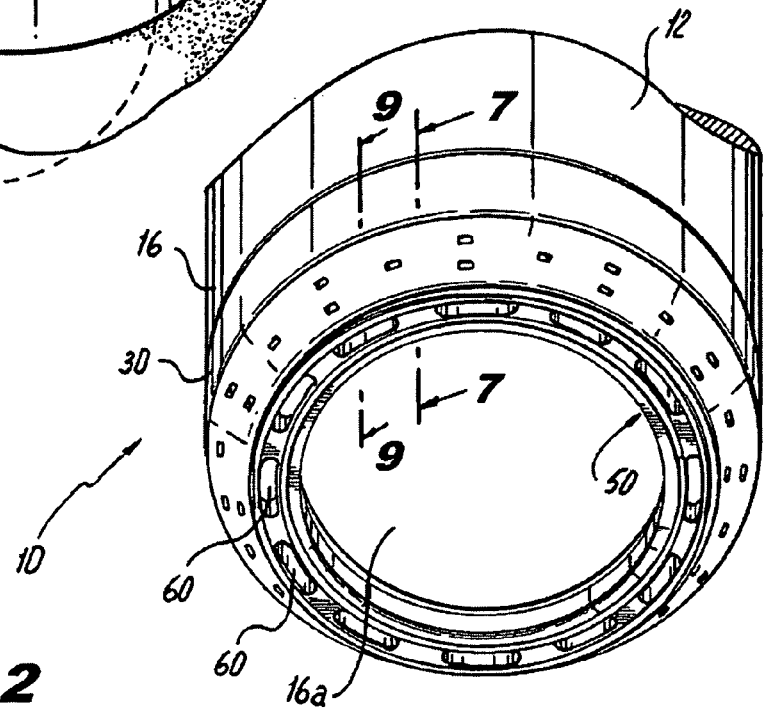
FIG. 2 is a perspective view of the bottom end of the compressed gas cylinder illustrated in FIG. 1.

Referring to FIGS. 2 and 3, gas cylinder assembly 10 further includes an annular collar 30 that surrounds the lower support ring 22 of cylinder body 12. The annular collar 30 is a molded structure, preferably made from a light-weight plastic material, such as, for example, polypropylene or high density polyethylene (HDPE). Collar 30 includes a continuous outer circumferential skirt 32 and a lower circumferential shelf 33. Skirt 32 is dimensioned and configured to enclose substantially the entire convex surface area 16*a* of the lower end portion 16 of cylinder body 12. Preferably, collar 33 is color matched to the handle assembly 20 for aesthetic purposes.

Figure 4:
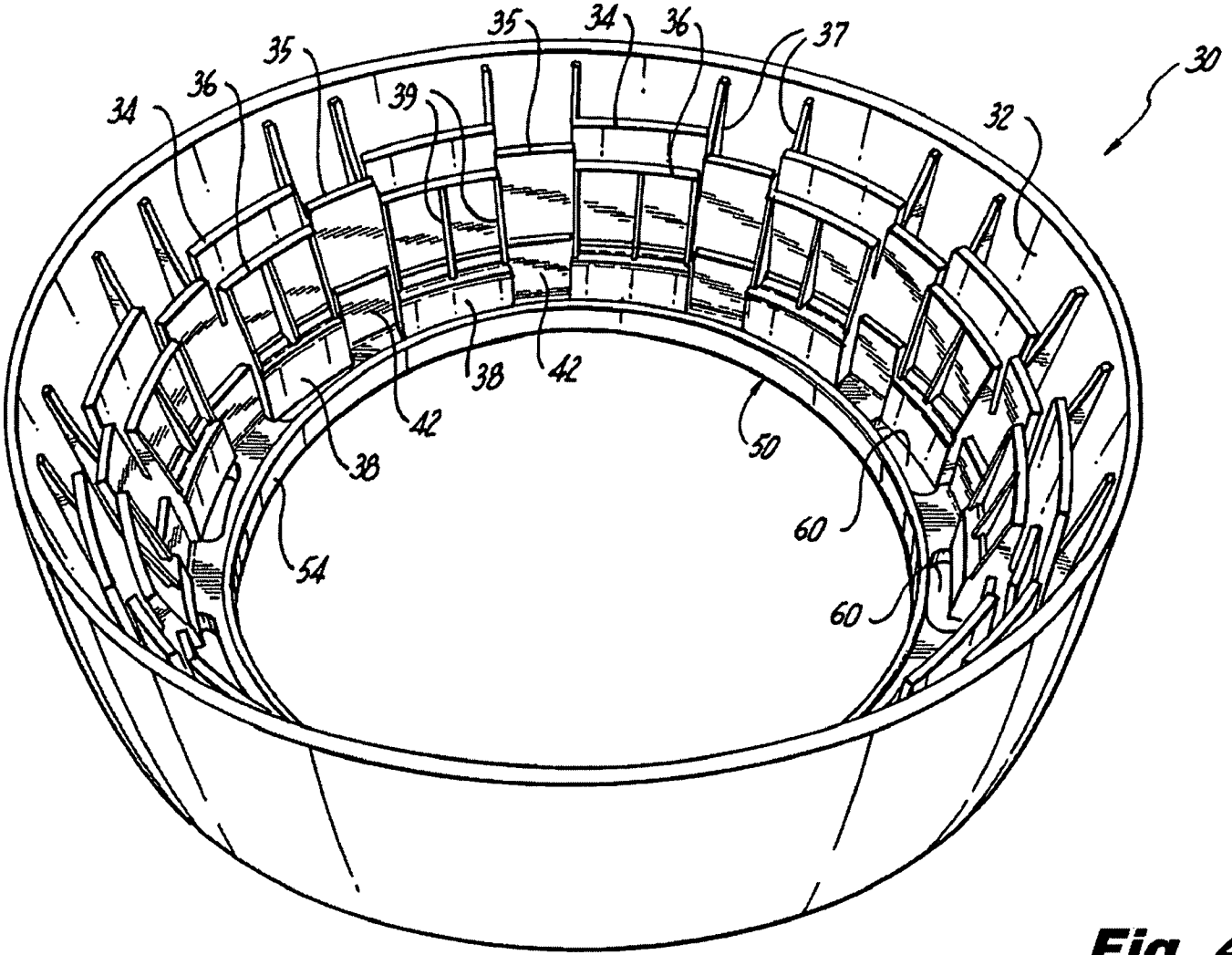
FIG. 4 is a perspective view of the annular collar and foot ring, in an assembled condition, viewed from above, and separated from the cylinder body.

Referring to FIG. 4, collar 30 includes an outer band of circumferentially spaced apart upstanding support fins 34 located radially inward of the outer circumferential skirt 32, a medial band of circumferentially spaced apart upstanding support fins 35 located radially inward of the outer band of support fins 34, and an inner band of circumferentially spaced apart upstanding support fins 36 located radially inward of the medial band of support fins 35. The support fins 34 of the outer band are radially aligned with the support fins 36 of the inner band, while the medial support fins 35 are radially interposed between aligned pairs of outer and inner support fins 34, 36. Circumferentially spaced apart lateral stiffening struts 37 extend between the outer skirt 32 and the lower bases of the outer band of support fins 36 to provide a degree of structural rigidity to the structures.

Figure 10:
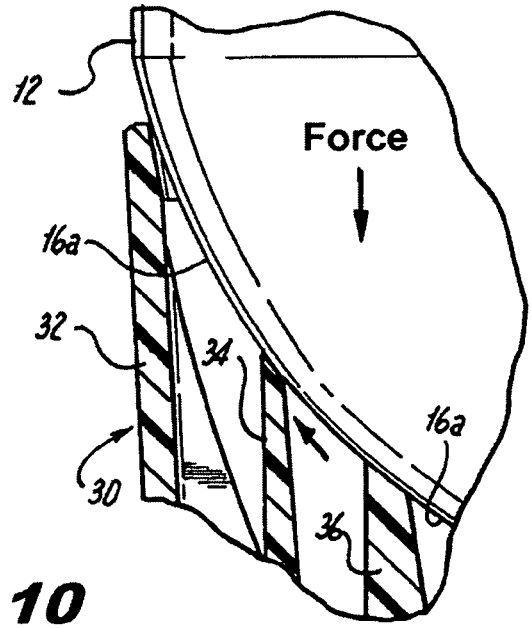

The three bands of circumferentially spaced apart support fins 34, 35 and 36 are relatively deflectable and have respective inclined upper edge surfaces 34*a*, 35*a* and 36*a* that generally match the curvature of and interact with the convex surface area 16*a* of the lower end portion 16 of cylinder body 12 to provide resilient shock absorbers in the event that the cylinder assembly 10 is dropped onto a supporting surface. This interaction is illustrated for example in FIG. 10.

Figure 9:
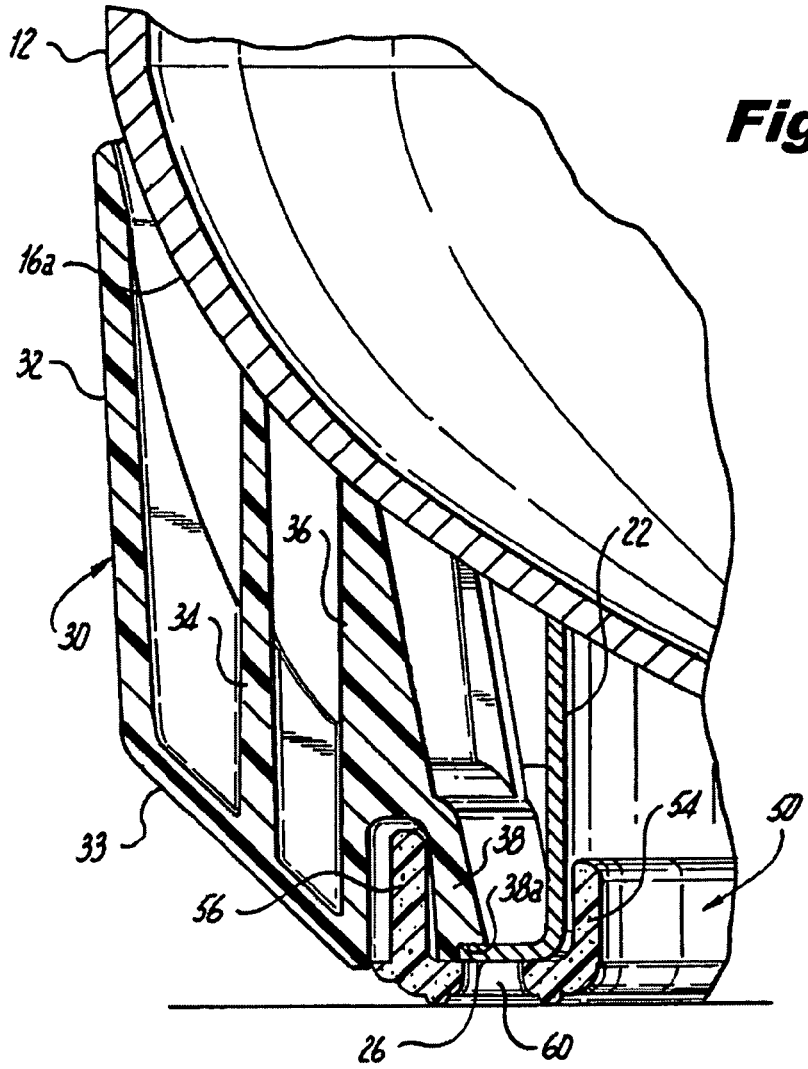
FIGS. 9 and 10 illustrate the circumferentially spaced apart deflectable support fins and the manner in which they interact with the convex surface of the lower end portion the cylinder body to provide resilient shock absorbers in the event that the cylinder is dropped onto a supporting surface.

With continuing reference to FIG. 4, an engagement strut 38 extends radially inwardly from each of the inner support fins 36 of the annular collar 30. The engagement struts 38 are strengthened by lateral stiffening ribs 39 dimensioned and configured to abut or otherwise engage the radially outwardly projecting support flange 26 of support ring 22, as best seen in FIG. 9. More particularly, as seen in FIG. 5, the lower surface of each engagement strut 38 has a stepped undercut 38*a* that accommodates the radially inner edge of the support flange 26 of support ring 22.

Figure 5:
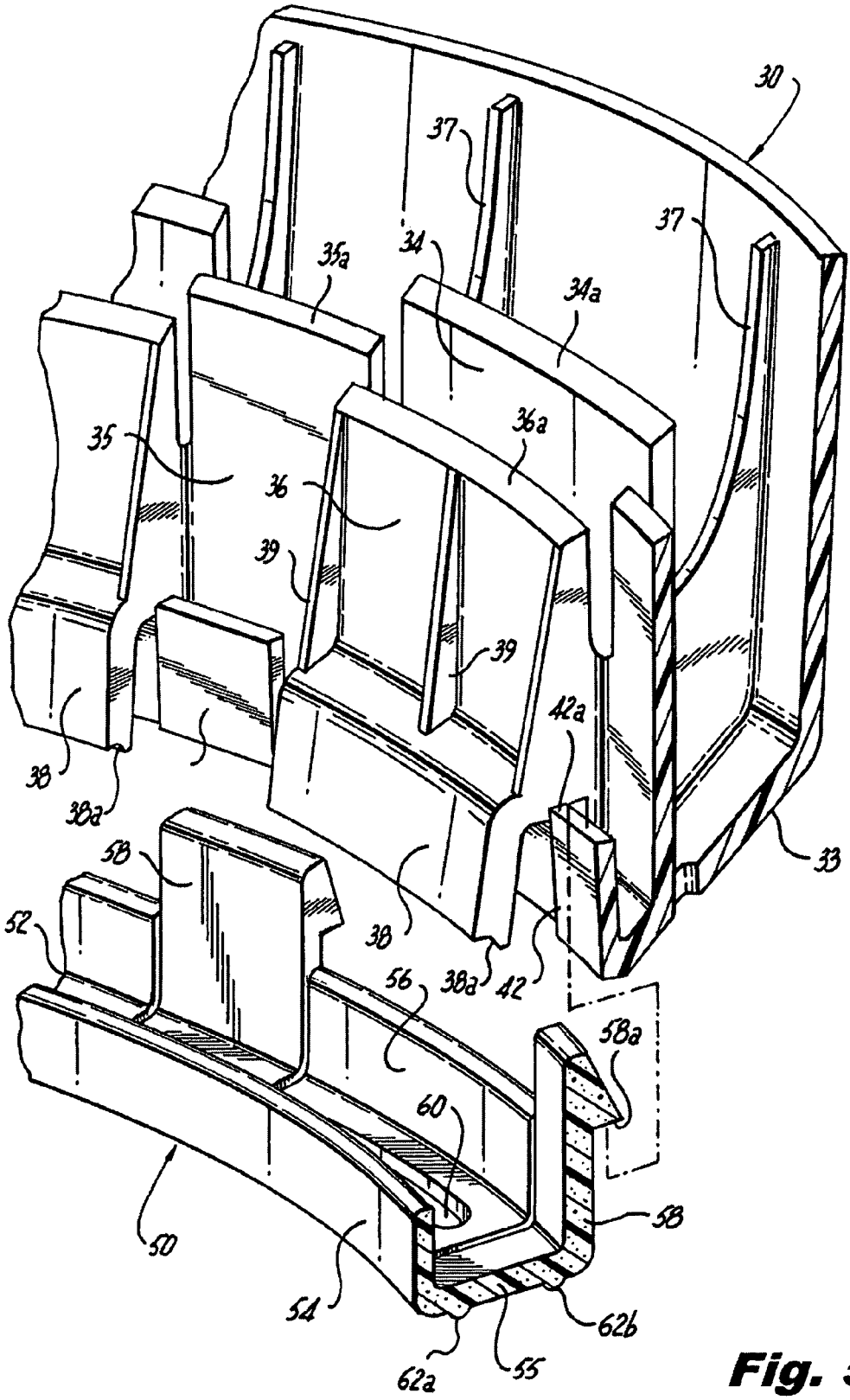
FIG. 5 is a localized partial cross-sectional view of the annular collar and foot ring in an unassembled condition.

Referring to FIG. 5, annular collar 30 also includes a plurality of circumferentially spaced apart upstanding retention tabs 42, each of which is disposed between a pair of engagements struts 38. The upstanding retention tabs 42 are located radially inward of the circumferentially spaced apart engagement struts 38 and are configured to lockingly interact with a foot ring 50, which is described in more detail herein below with reference to FIG. 6.

Figure 6:
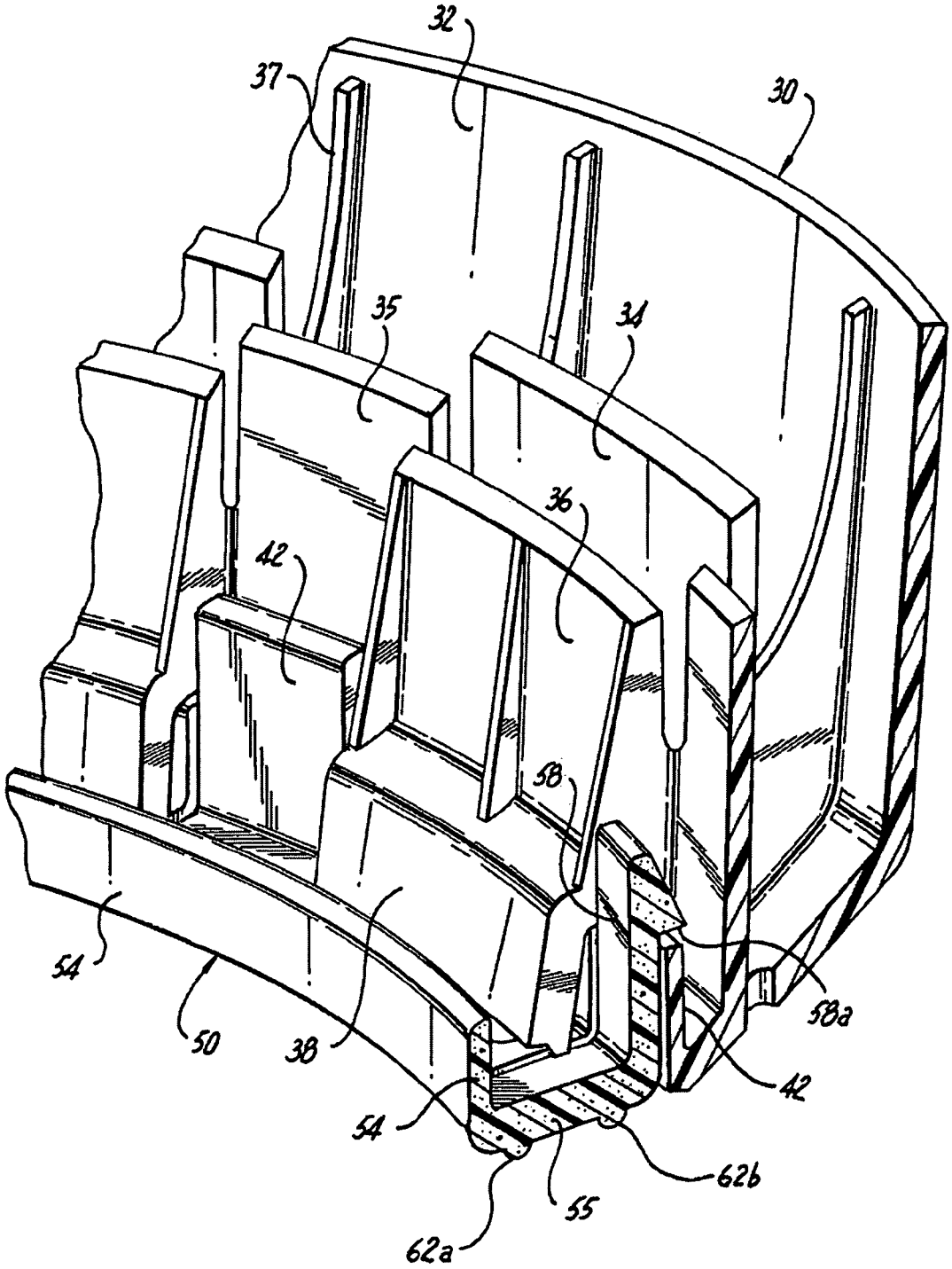
FIG. 6 is a localized partial cross-sectional view of the annular collar and foot ring in an assembled condition.
Figure 7:
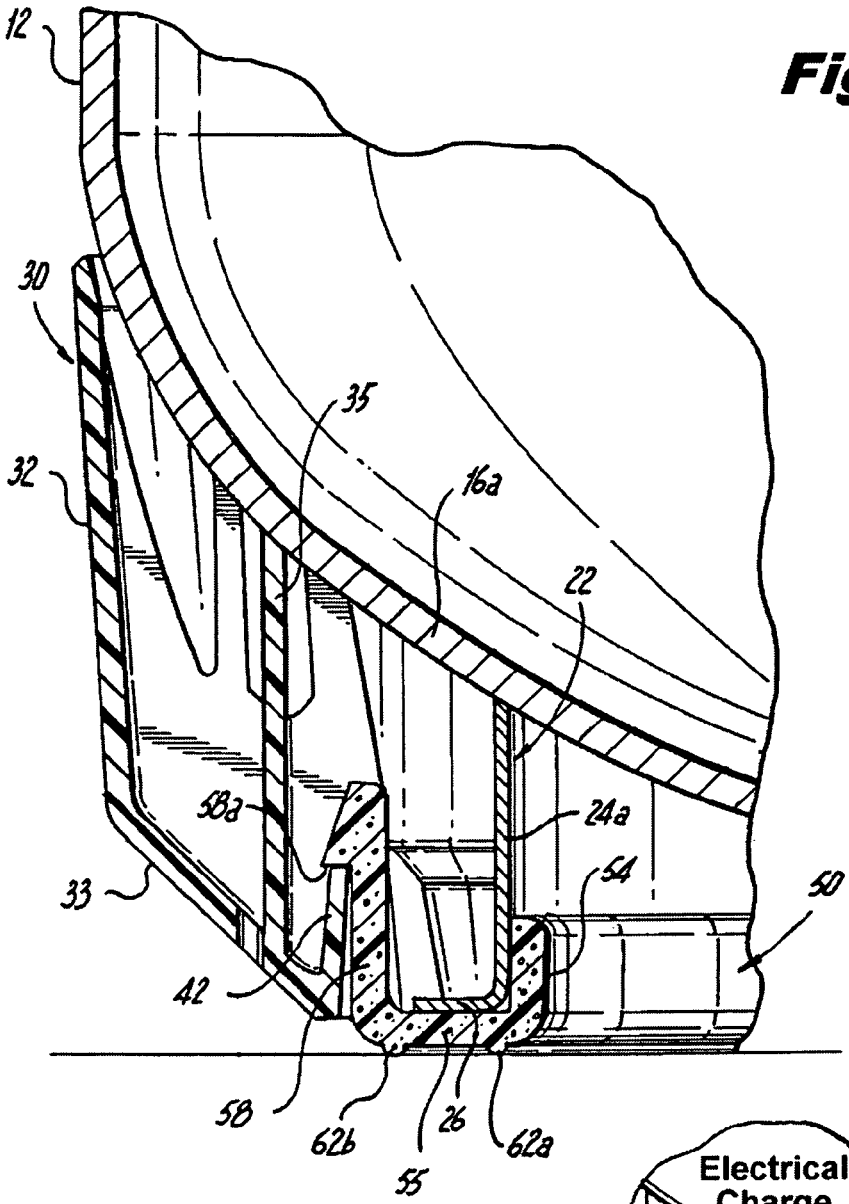
FIG. 7 is an enlarged cross-sectional view taken along line 7-7 of FIG. 2, illustrating the assembled components of the compressed gas cylinder of the subject invention, upon a supporting surface.

Referring to FIGS. 5 and 6, foot ring 50 defines an annular channel 52 for accommodating the engagement struts 38 of annular collar 30 and the lower support ring 22 of cylinder body 12. The annular channel 52 of foot ring 50 includes a radially inner upstanding wall 54 dimensioned and configured to surround the inner peripheral surface 24*a* of the lower support ring 22, as best seen in FIG. 7. The annular channel 52 of foot ring 50 further includes a base section 55 and an upstanding sectioned radially inner wall structure 56. The radially outer wall structure 56 includes a plurality of circumferentially spaced apart radially outer upstanding engagement tangs 58 each having an undercut 58*a* dimensioned and configured to lockingly engage the upper surface 42*a* of a correspondingly positioned retention tab 42 of annular collar 30.

Preferably, the foot ring 50 of gas cylinder assembly 10 is formed from a conductive or semi-conductive polymeric material, such as for example, a semi-conductive compound based on polypropylene or high density polyethylene (HDPE). An example of a suitable polypropylene-based conductive material is CESA® conductive PP90025540, manufactured by Clairiant Masterbatches GmbH.

Figure 8:
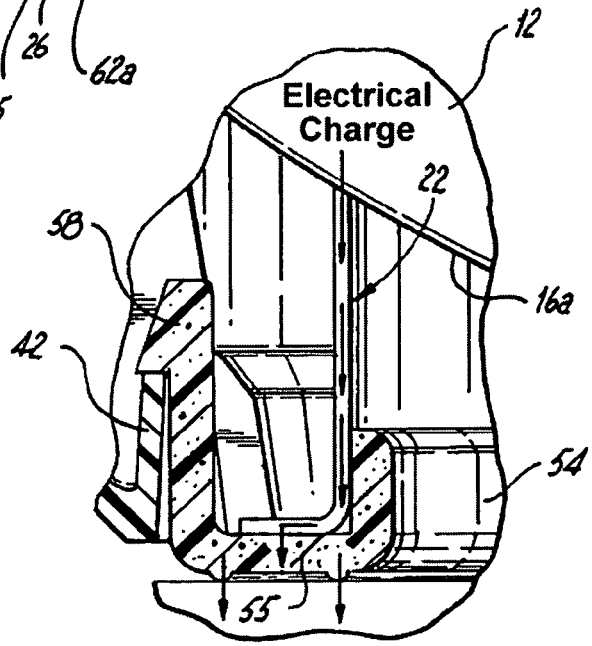
FIG. 8 is an illustration of the way in which the foot ring provides a conductive pathway between the cylinder body and a supporting surface to discharge static electricity from the cylinder body.

As best seen in 2 and 3, the base section 55 of the conductive polymeric foot ring 50 includes a plurality of kidney shaped apertures 60 for material weight reduction. In addition, the bottom surface of the base section 55 includes a pair of radially spaced apart circumferential support beads 62*a*, 62*b* for contacting a supporting surface, such as for example, the platform of a filling station, as shown in FIG. 8.

Referring to FIG. 7, when the engagement tangs 58 of the conductive polymeric foot ring 50 are lockingly engaged with the upstanding retention tabs 42 of annular collar 30, the inner peripheral surface 24*a* of the lower support ring 22 is in intimate contact with the radially inner upstanding wall 54 of foot ring 50. In addition, at such a time, the radially inwardly projecting support flange 26 of the lower support ring 22 of cylinder body 12 is in intimate contact with the base section 55 of foot ring 50. As a result of this mechanical construct, there is an electrically conductive pathway that exists between the metallic cylinder body 12 and the conductive polymeric foot ring 50, as illustrated n FIG. 8.

Therefore, when the compressed gas cylinder assembly 10 of the subject invention enters a filling station having a metal support surface of platform, static electricity held by the metallic cylinder body 12 can be safely and advantageously conducted to the grounded metallic filling platform or to the transport chains of the filling station through the conductive foot ring 50. Furthermore, because the foot ring is not metallic, it will not leave rust stains on flooring or carpeting when it is situated indoors in a kitchen or living room.

While the subject invention has been described with respect to preferred embodiments, those skilled in the art will readily appreciate that changes and modifications may be made thereto without departing from the spirit and scope of the subject invention as defined by the appended claims.

What is claimed is:

1. A gas cylinder assembly comprising:

a) a metallic cylinder body having an upper end portion including handles and a flow control valve and a lower end portion with a depending lower support ring that includes an annular wall having a radially outwardly projecting support flange;

b) a non-conductive annular collar surrounding the lower support ring of the cylinder body, the annular collar having a plurality of circumferentially spaced apart radially inwardly facing engagement struts for engaging the support flange of the lower support ring about a periphery thereof; and c) a conductive foot ring connecting the non-conductive annular collar to the lower support ring of the metallic cylinder body, the foot ring defining an annular channel for accommodating the engagement struts of the annular collar and the lower support ring of the cylinder body, wherein the conductive ring is in intimate contact with the lower support ring of the cylinder body, to provide a conductive path to ground for the cylinder body.

2. A gas cylinder assembly as recited in claim 1, wherein the annular collar and foot ring are formed from polymeric materials.

3. A gas cylinder assembly as recited in claim 1, wherein the annular channel of the foot ring includes a radially inner upstanding wall which surrounds an inner periphery of the annular wall of the lower support ring and a plurality of circumferentially spaced apart radially outer upstanding engagement tangs which surrounds the annular collar in interleaved relationship with the plurality of circumferentially spaced apart engagement struts.

4. A gas cylinder assembly as recited in claim 1, wherein the annular collar includes shock absorption means for interacting with the lower end portion of the cylinder body.

5. A gas cylinder assembly as recited in claim 4, wherein the shock absorption means includes a plurality of circumferentially spaced apart, upstanding deflectable fins.

6. A gas cylinder assembly as recited in claim 1, wherein the foot ring is formed from a conductive polymeric material.

7. A gas cylinder assembly as recited in claim 1, wherein the foot ring is formed from a semi-conductive polymeric material.

* * * * *